US008327889B2

(12) United States Patent
Ashrafzadeh et al.

(10) Patent No.: US 8,327,889 B2
(45) Date of Patent: Dec. 11, 2012

(54) HANDS FREE, CONTROLLED AUTOFILL FOR A DISPENSER

(75) Inventors: Farhad Ashrafzadeh, Stevensville, MI (US); Kevin M. Chase, Saint Joseph, MI (US); Brian P. Janke, Ann Arbor, MI (US); Shreecharan Kanchanavally, Lisle, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 588 days.

(21) Appl. No.: 12/550,831

(22) Filed: Aug. 31, 2009

(65) Prior Publication Data

US 2009/0314801 A1 Dec. 24, 2009

Related U.S. Application Data

(63) Continuation-in-part of application No. 12/103,170, filed on Apr. 15, 2008, now Pat. No. 7,673,661.

(51) Int. Cl.
*B65B 1/30* (2006.01)

(52) U.S. Cl. ..... 141/94; 141/192; 62/389

(58) Field of Classification Search ..... 141/83, 141/94–96, 192, 198, 351, 360, 1; 73/290 R; 62/389; 250/221, 222.1; 222/23, 52
See application file for complete search history.

(56) References Cited

U.S. PATENT DOCUMENTS

| | | | | |
|---|---|---|---|---|
| 3,823,846 | A | | 7/1974 | Probst |
| 4,202,387 | A | | 5/1980 | Upton |
| 4,437,497 | A | | 3/1984 | Enander |
| 4,446,896 | A | | 5/1984 | Campagna |
| 4,929,843 | A | * | 5/1990 | Chmielewski et al. .. 250/559.05 |
| 5,491,333 | A | | 2/1996 | Skell et al. |
| 5,534,690 | A | * | 7/1996 | Goldenberg et al. ..... 250/222.1 |
| 5,551,598 | A | | 9/1996 | Cutsinger |
| 5,640,468 | A | * | 6/1997 | Hsu ..... 382/190 |
| 5,902,998 | A | | 5/1999 | Olson et al. |
| 6,082,419 | A | | 7/2000 | Skell et al. |
| 6,100,518 | A | | 8/2000 | Miller |
| 6,406,227 | B1 | * | 6/2002 | Titus et al. ..... 409/81 |
| 6,473,190 | B1 | | 10/2002 | Dosmann |
| 6,681,585 | B1 | | 1/2004 | Stagg et al. |
| 6,688,134 | B2 | | 2/2004 | Barton et al. |
| 6,705,356 | B2 | | 3/2004 | Barton et al. |
| 7,028,725 | B2 | | 4/2006 | Hooker |
| 7,034,272 | B1 | * | 4/2006 | Leonard et al. ..... 250/208.1 |
| 7,109,512 | B2 | | 9/2006 | Wirthlin |
| 7,201,005 | B2 | | 4/2007 | Voglewede et al. |
| 7,210,601 | B2 | | 5/2007 | Hortin et al. |
| 7,353,850 | B2 | | 4/2008 | Greiwe et al. |
| 7,447,558 | B2 | * | 11/2008 | Pratt ..... 700/118 |
| 8,028,728 | B2 | * | 10/2011 | Cooper ..... 141/351 |
| 2006/0096303 | A1 | | 5/2006 | Kavounas |
| 2008/0023659 | A1 | | 1/2008 | Dietz et al. |
| 2008/0083475 | A1 | | 4/2008 | Lamb |
| 2011/0214441 | A1 | * | 9/2011 | Ashrafzadeh et al. ..... 62/129 |

* cited by examiner

*Primary Examiner* — Gregory Huson
*Assistant Examiner* — Jason K Niesz
(74) *Attorney, Agent, or Firm* — Kirk W. Goodwin; Diederiks & Whitelaw PLC

(57) ABSTRACT

A dispensing system includes a digital image capture device focused on a dispenser well for capturing images of containers in the dispenser well and a digital image analyzer operatively coupled to the digital image capture device. The digital image analyzer evaluates digital images of containers captured by the digital image capture device to determine physical parameters of each container placed in the dispensing well. An actual dispensing operation is automatically regulated based on characteristics of the container.

21 Claims, 3 Drawing Sheets

HANDS FREE, CONTROLLED AUTOFILL FOR A DISPENSER

The present invention represents a continuation-in-part of U.S. patent application Ser. No. 12/103,170, filed Apr. 15, 2008, pending.

BACKGROUND OF THE INVENTION

1. Field of the Invention

The present invention pertains to the art of dispensing and, more particularly, to a sensor system that employs digital imaging technology to determine, among other things, the dimensions and volume of a container positioned in a dispensing well.

2. Description of the Related Art

Refrigerators having built-in ice/water dispensers are well known in the art. In general, the dispensers are mounted to a door of the refrigerator for the purpose of dispensing ice and/or water without requiring a user to access a refrigerator compartment. A typical dispenser includes a dispenser well into which a container is placed. Once the container is in position, an actuator is operated to release the ice and/or water into the container.

In many cases, the actuator is a pressure sensitive mechanical switch. Typically, the switch is operated by pushing the container against, for example, a lever. The lever, in turn, operates the switch that causes the ice and/or water to be dispensed. A number of dispensers employ multiple actuators, one for ice and another for water, while other dispensers employ a single actuator. Dispensers which employ a single actuator typically require additional control elements that enable a user to select between ice and water dispensing operations. Several manufacturers have converted from mechanical switches to electrical or membrane switches. Functioning in a similar manner, a container is pushed against the membrane switch to initiate the dispensing operation. Still other arrangements employ actuator buttons provided on a control panel of the dispenser. With this type of arrangement, the user continuously depresses a button to release ice and/or water into the container.

Over time, mechanical and membrane switches can wear out. Physical interaction with the switches results in wear and tear on contact points, springs, levers and the like which eventually require replacement. In addition, most existing systems lack an automatic cut-off feature. More specifically, once activated, the dispenser will discharge water or ice until the pressure is removed from the actuator. If the user is momentarily distracted, or if the dispenser is operated by an inexperienced individual such as a child, ice and/or water can overflow the container. In order to address this concern, manufacturers have developed automatic cut off features for dispensers. However, existing automatic cut-off controls, many of which are based solely on container height, are not overly effective. If a container is not properly located within the dispenser well, either too little or too much water/ice will be dispensed. In addition, existing systems are not able to account for various container shapes, such as water bottles, coffee pots and the like. Differences in container shape affect how much liquid should be dispensed into the container. Furthermore, existing systems often employ sensors or displays mounted on a bezel which prevents the bezel from being changed without significant modification.

Therefore, despite the existence of refrigerator dispensers in the prior art, there exists a need for an enhanced dispensing system, whether limited to refrigerators or other dispensing arrangements such as countertop dispensers. More specifically, there exists a need for a dispensing system that employs a sensor system that detects the dimensions and volume of a container and initiates a dispensing operation based on the particular container. In addition, there exists a need for a sensor system that does not interfere with the changeability of a bezel module associated with a display/control of the dispenser.

SUMMARY OF THE INVENTION

The present invention is directed to a sensing system for a dispenser, such as a refrigerator dispenser or countertop dispenser. The sensing system is arranged in the dispenser area and configured to detect a container positioned to receive ice and/or water. In accordance with the invention, the sensing system employs a digital image capture device which is focused upon the dispensing area. The digital image capture device is coupled to a digital image analyzing system that processes images of the dispensing area to determine the presence of a container within the dispensing area. Additionally, digital images of a container within the dispensing area are processed to determine the volume of the container. With this information, the container can be automatically filled to a pre-specified level or volume. Furthermore, the digital image capture device is mounted so as to not interfere with the changing of a bezel associated with the dispenser.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
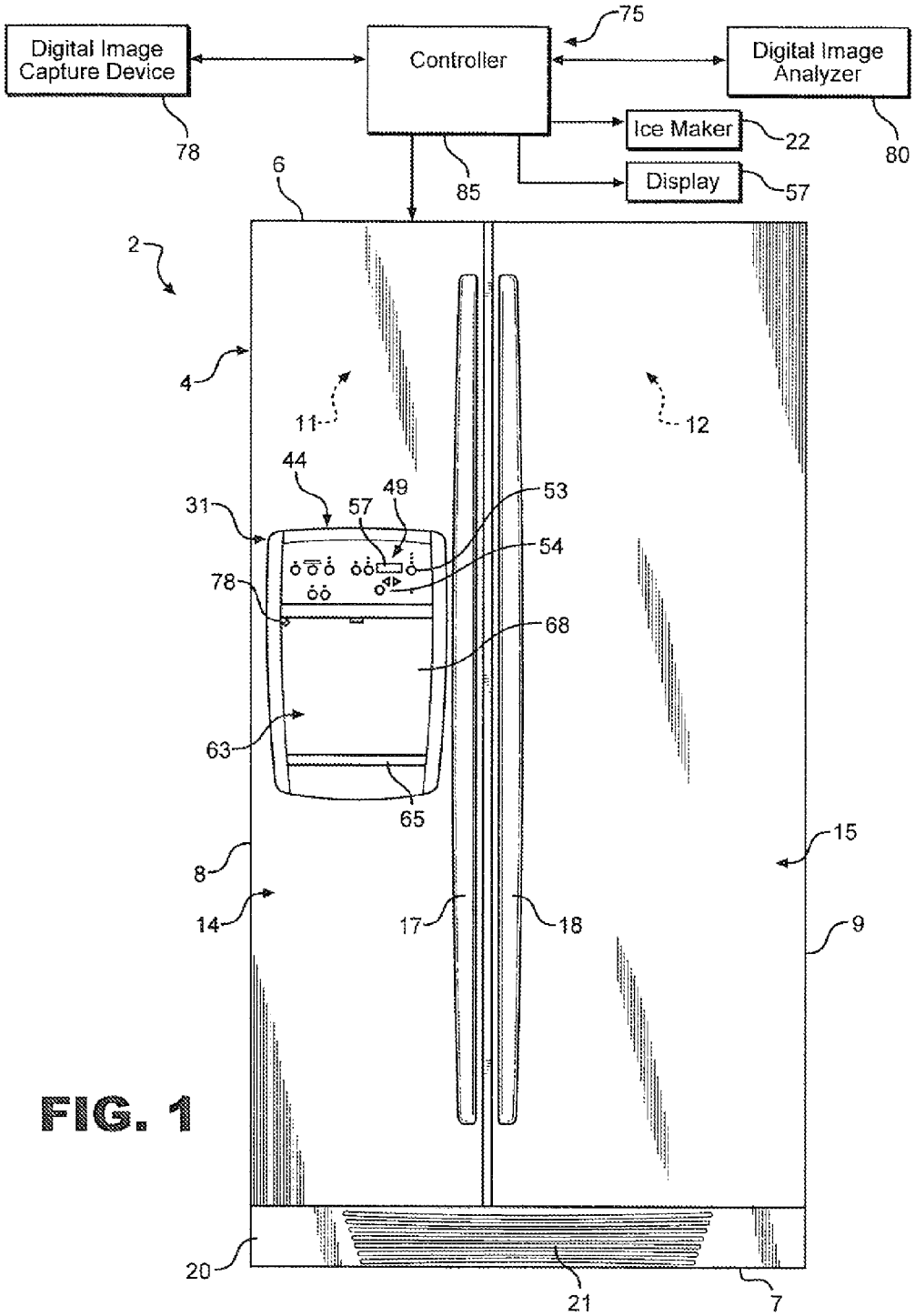
FIG. 1 is a front elevational view of a refrigerator incorporating a dispenser having a sensor system constructed in accordance with the present invention.

With initial reference to FIG. 1, a refrigerator constructed in accordance with the present invention is generally indicated at 2. Refrigerator 2 includes a cabinet 4 having a top wall 6, a bottom wall 7 and opposing side walls 8 and 9. In a manner known in the art, refrigerator 2 includes a freezer compartment 11 arranged along side a fresh food compartment 12. Freezer compartment 11 includes a corresponding freezer compartment door 14 and fresh food compartment 12 includes a corresponding fresh food compartment door 15. In a manner also known in the art, each door 14, 15 includes an associated handle 17, 18. Refrigerator 2 is also shown to include a kick plate 20 arranged at a bottom portion thereof having a vent 21 that permits air to flow into refrigeration components (not shown) that establish and maintain desired temperatures in freezer compartment 11 and fresh food compartment 12. In the embodiment shown, refrigerator 2 constitutes a side-by-side model. However, it should be understood that the present invention could also be employed in connection with a wide variety of refrigerators, including top mount, bottom mount, and French-style refrigerator models.

In accordance with the invention, refrigerator 2 includes an icemaker 22, a dispenser assembly 31 having a main housing 44 and a control panel 49 defining a bezel (not separately labeled). Control panel 49 includes first and second rows of control buttons 53 and 54 which enable a user to select a preferred dispensing operation. Control panel 49 further includes a display 57 which, in addition to functioning in cooperation with dispenser assembly 40, enables the user to select particular operational parameters for refrigerator 2 such as, desired temperatures for freezer compartment 11 and fresh food compartment 12.

Dispenser assembly 31 includes a dispenser well 63 having a base or container support portion 65, a recessed, upstanding wall section 68 and a pair of opposing side walls 69 and 70. A nozzle or spigot is arranged in an upper portion (not separately labeled) of dispenser well 63 and aimed to deliver a flow of water or other liquid downward into a container (shown at 91 in FIG. 2) placed in dispenser well 63. An ice outlet (not shown) is provided in an upper portion of dispenser well 63 for dispensing ice. In accordance with the invention, dispenser assembly 31 includes a sensor system 75 that detects both the size and shape of a container placed within dispenser well 63. As will be detailed more fully below, sensor system 75 employs at least one digital image capture device 78 positioned in dispenser well 63.

Figure 2:
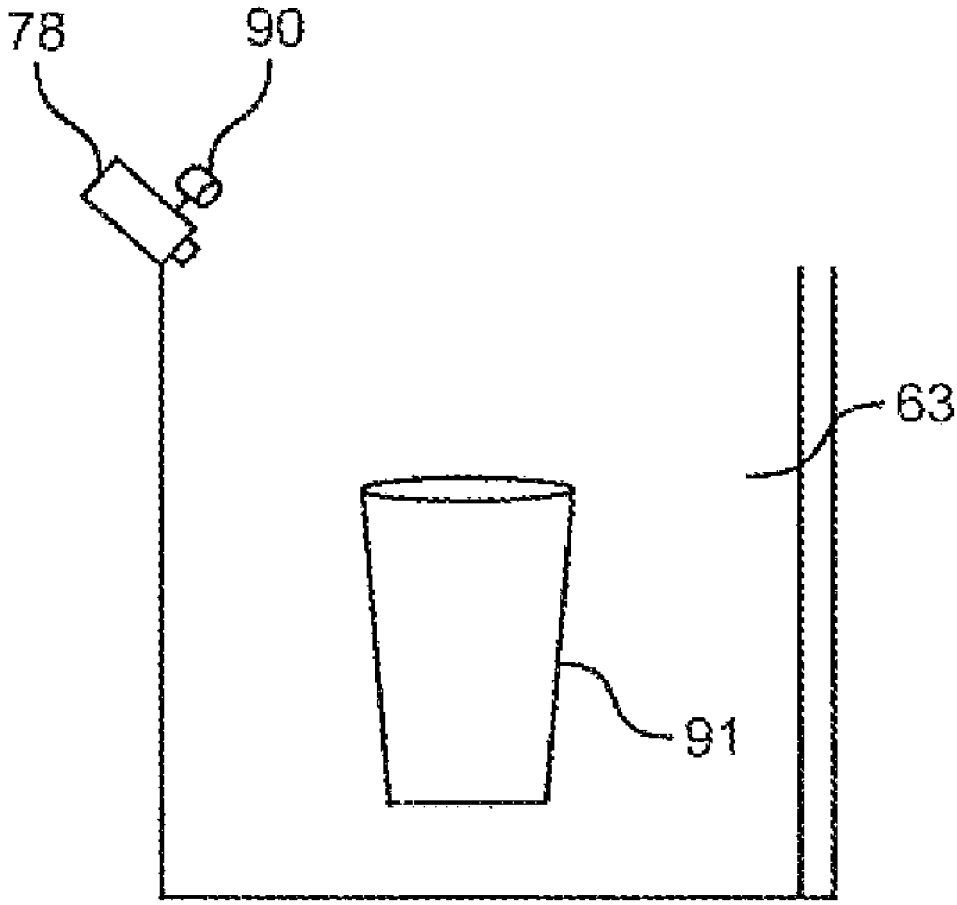
FIG. 2 is a schematic representation of a sensor system employing digital imaging to determine container height and shape.

Digital image capture device 78 can take on a variety of forms, such as a charged/coupled device (CCD) camera or complimentary metal oxide semiconductor (CMOS) camera. As shown in FIG. 2, digital image capture device 78 is preferably operatively connected to a light source 90 which produces light of one or more wavelengths. That is, light source 90 can bathe dispenser well 63 in white light, colored light or non-visible light depending upon a particular parameter of interest. Digital image capture device 78 is linked to a controller 85 of sensor system 75 which performs algorithmic processing of the data. Light source 90 (either IR or visible) is utilized to illuminate a container 91, allowing capture device 78 to accurately detect a rim, while enabling the diameter, height and other physical parameters of container 91 to be determined, from which an estimated volume can be computed.

Capture device 78 is preferably mounted in an uppermost portion of dispenser well 63 so as to not interfere with the changeability of a bezel for dispenser well 63. In addition, capture device 78 is preferably focused downward at both ice and water dispensing areas to capture digital images of objects that enter dispenser well 63. Objects in dispenser well 63 are contrasted against a reference image, i.e., the background of dispenser well 63, for clarity. In the depicted embodiment, digital image capture device 78 takes the form of a camera that is positioned in dispenser well 63 to capture a side view of container 91. As will be discussed more fully below, the image is passed to digital image analyzing system 80. Analyzing system 80 corrects the image and performs edge based image segmentation of the image in order to detect the top and bottom points of container 91, along with the opening of the container 91, thereby verifying the presence of container 91, movement of container 91 in dispenser well 63 and the requisite physical parameters. With this information, controller 85 can effectively regulate operation of dispensing assembly 31, including display 57 and the liquid/ice dispensing operations.

Figure 3:
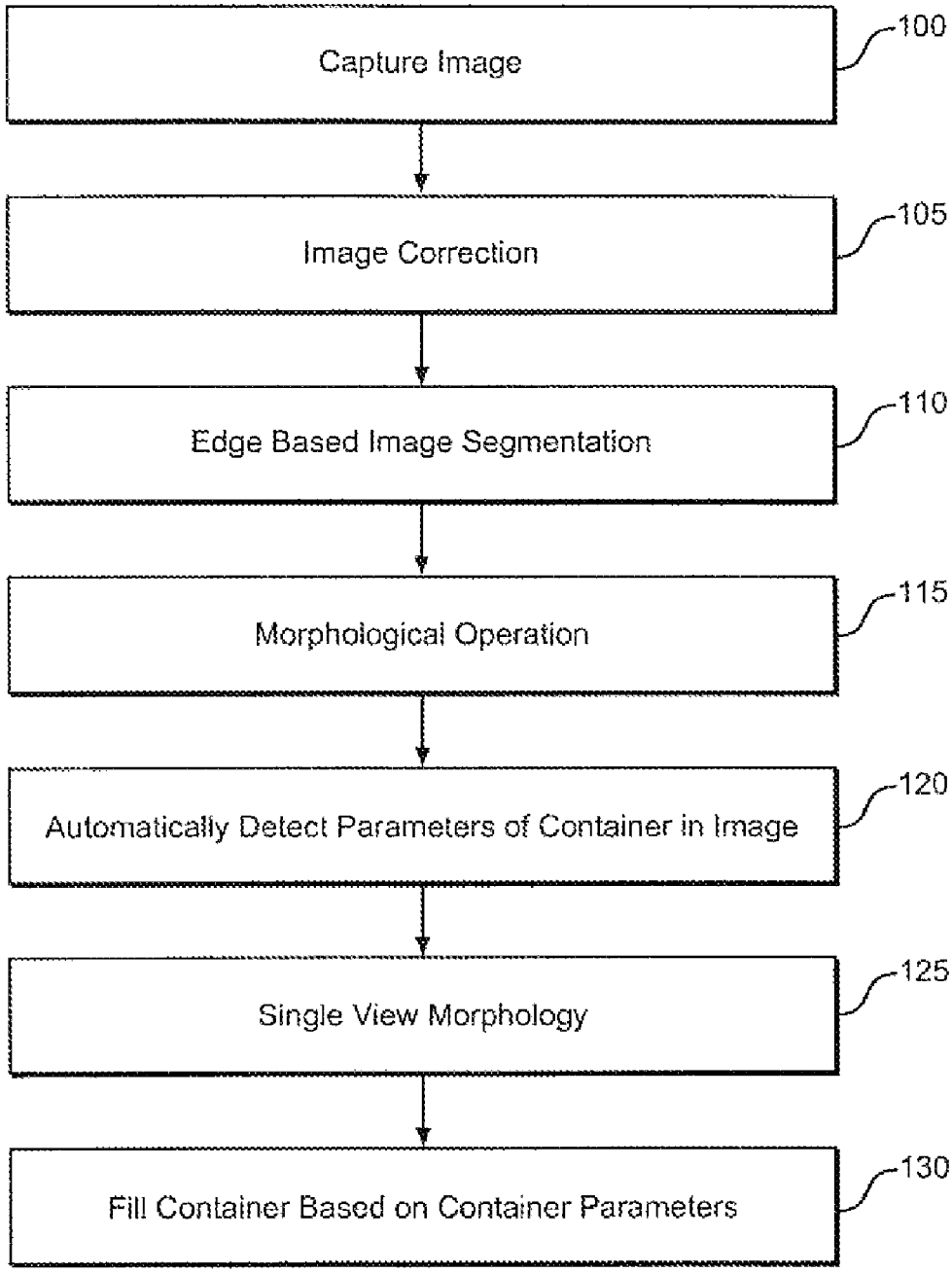
FIG. 3 is a flow chart illustrating the dispensing method in accordance with the present invention.

The operation of sensor system 75 of the present invention will now be described with reference to FIG. 3. As shown in block 100, sensor system 75 includes a digital image capture device 78 which captures one or more digital images and sends the digital image(s) to controller 85 as such objects enter dispenser well 63. Controller 85 passes the digital images to digital image analyzer 80 which analyzes the images to first determine that container 91 is present through image comparisons, then determines the shape and volume of a container 91 in dispenser well 63, as well as any container movement. More particularly, an image processing algorithm is carried out to determine the shape and size of container 91. That is, each image is first subjected to an image correction step in block 105 to correct distortions in the image that result from the use of a fish eye lens or the like in image capture device 78. The corrected image then undergoes edge based image segmentation to distinguish objects from the background in block 110. The background color is filtered out of the image, thus filtering out the background from the image. Following segmentation, the image is subjected to a morphological operation in block 115 to remove additional noise so the edges of the container appear clearer. This is accomplished by blowing up the image so the edges of the container appear thicker and unwanted background noise can be removed. The container is now fully detected and separated from the background. Thus, the top, bottom, and opening points of the container are automatically detected in block 120. The image then undergoes single view morphology in block 125, a process by which the actual dimensions of the container are determined from the measurements of the image of the container. In particular, the pixel points of the image are determined and a projection algorithm is used to determine the actual height and diameter of the container. Liquid or ice is then be automatically dispensed to fill the container in block 130 based on the particular container parameters. If container 91 is moved relative to dispenser well 63 such that container 91 becomes mis-aligned prior to completion of the dispensing operation, the dispensing operation can be cut off to prevent spillage.

Although described with reference to preferred embodiments of the invention, it should be readily understood that various changes and/or modifications can be made to the invention without departing from the spirit thereof. In general, it should be readily apparent that the present invention employs a sensing system which can advantageous sense or determine each of the presence, positioning, height, shape and volume of a container placed in a dispensing well. Additionally, a fill level of the container and even the material of the container can actually be sensed. A dispensing operation can be automatically performed when the presence of the container is sensed in the dispensing well and the container is properly positioned relative to a dispensing nozzle of the well. In addition, the actual dispensing operation is controlled or regulated based on the height and volume of the container, as well as sensed movement of the container in the dispensing well. In this manner, dispensing operations can only be performed when a container is appropriately arranged in the dispensing well and the dispensing operation will be timely terminated based on the physical parameters of the particular container employed. Finally, although described with reference to a refrigerator dispenser, the invention can also be employed with other types of liquid and/or ice, such as countertop dispensers for ice and/or various beverages including coffee, milk, soda, water and the like. In any case, the invention is only intended to be limited by the scope of the following claims.

What is claimed is:

1. A dispenser assembly for selectively releasing at least one of liquid and ice to a consumer through a dispensing operation, said dispenser assembly comprising:

a dispenser well provided in a main housing, said dispenser well including an upper portion, a base section for supporting a container, a recessed upstanding wall section and opposing side wall sections;

a dispensing outlet arranged in the upper portion of the dispenser well for delivering the at least one of liquid or ice into the dispensing well; and a sensor system including a digital image capture device focused on the dispenser well for capturing images of containers positioned in said dispenser well and a digital image analyzer operatively coupled to the digital image capture device for evaluating the images of the containers captured by the digital image capture device to determine physical parameters of the containers.

2. The dispenser assembly according to claim 1, wherein the digital image capture device includes a light source for illuminating containers for imaging purposes.

3. The dispenser assembly according to claim 2, wherein the light source projects colored light into the dispensing well.

4. The dispenser assembly according to claim 1, wherein the digital image analyzer employs image segmentation to distinguish objects from a background in said image.

5. The dispenser assembly according to claim 4, wherein the digital image analyzer performs edge based image segmentation.

6. The dispenser assembly according to claim 1, wherein the digital image capture device is a charged/coupled device (CCD) camera.

7. The dispenser assembly according to claim 1, wherein the digital image capture device is a complementary metal oxide semiconductor (CMOS) camera.

8. The dispenser assembly according to claim 1, further comprising: a controller for regulating the dispensing operation based on the physical parameters.

9. The dispenser assembly according to claim 8, wherein the physical parameters include a volume of a container placed in the dispenser well.

10. The dispenser assembly according to claim 8, wherein the physical parameters include height and shape features of a container placed in the dispenser well.

11. The dispenser assembly according to claim 1 further comprising, in combination: a cabinet; at least one refrigerated compartment arranged with the cabinet; and a door mounted to the cabinet for selectively providing access to the at least one refrigerated compartment, wherein the dispensing assembly is provided in the door of the cabinet.

12. The dispenser assembly according to claim 11, further comprising: a bezel provided about the dispenser well, said bezel being spaced from the sensor system, so as to be changeable without displacing the sensor system.

13. A method of performing a dispensing operation from a dispenser assembly including a dispensing well comprising: capturing an image of a container placed in the dispensing well with a digital image capture device; analyzing the image to determine physical parameters of the container placed in the dispensing well; and regulating the dispensing operation based on the physical parameters of the container.

14. The method of claim 13, further comprising: initiating the dispensing operation by introducing at least one of liquid and ice into the container when a presence of the container is sensed in the dispenser well based on the image.

15. The method of claim 14, further comprising: automatically initiating the dispensing operation when the presence of the container is sensed; and automatically terminating the dispensing operation based on the physical parameters of the container or upon movement of the container relative to the dispensing well which would cause spillage.

16. The method of claim 13, further comprising: operating a light source of the digital image capture device to illuminate the container for imaging purposes.

17. The method of claim 16, wherein the step of analyzing the image includes performing edge based image segmentation.

18. The method of claim 16, wherein the step of analyzing the image includes performing a morphological operation on the image.

19. The method of claim 16, wherein the step of analyzing the image includes automatically detecting parameters of the container in the image.

20. The method of claim 16, wherein the step of analyzing the image includes performing single view morphology on the image.

21. The method of claim 13, further comprising: changing a bezel about the dispensing well without displacing the digital image capture device.

* * * * *